United States Patent [19]

Williams

[11] 4,109,946

[45] Aug. 29, 1978

[54] MACRAME STAND

[76] Inventor: Edward Lee Williams, 965 Avenue of the Pines, Grenada, Miss. 38901

[21] Appl. No.: 768,269

[22] Filed: Feb. 14, 1977

[51] Int. Cl.[2] ..... B65H 69/04; D04G 5/00

[52] U.S. Cl. ..... 289/18; 248/122

[58] Field of Search ..... 28/149; 289/1.5, 18; 248/122, 5

[56] References Cited

U.S. PATENT DOCUMENTS

| | | | |
|---|---|---|---|
| 3,091,886 | 6/1963 | Nutting | 248/122 X |
| 4,003,592 | 1/1977 | Schreues | 289/18 |
| 4,029,347 | 6/1977 | Garcia | 289/18 |
| 4,047,684 | 9/1977 | Kobayashi | 248/122 |

*Primary Examiner*—Louis K. Rimrodt

*Attorney, Agent, or Firm*—James D. Haynes

[57] ABSTRACT

A support means having a vertically adjustable telescoping member with a first cantilevered member thereon for supporting a clasping means for engagement with the holding cord or other origin point of macrame to support same during the knotting process. A clasp on a second cantilevered member disposed beneath the first cantilevered member engages the holding cord to maintain the cord in a taut position as desired. Horizontal members extend from the vertical support to control the ends during the practice of macrame.

10 Claims, 6 Drawing Figures

MACRAME STAND

BACKGROUND OF THE INVENTION

Macrame is an ancient art. Examples of it have been found in the ancient pyramids. It, like many other crafts, suffered a decrease in popularity and, for a time, became a lost art. During its recent revitalization, it has been enthusiastically adopted as a new craft.

Much of the practice of macrame takes place in the home. The twine is usually attached to hooks or door knobs or held in the lap of the knotter. Boards are also frequently used to accommodate pins for securing the ends thereto during the knotting process. The larger creations usually require the rod or board to which the twine is attached to be suspended from ceilings or bare pipes.

There has been a need for a convenient means for securing the holding cord or sinnet while one completes the work. While this has traditionally been met by hanging the work from hooks in the ceiling or lighting fixtures, this does not enable the user to easily tie knots without standing and does not offer mobility.

SUMMARY OF THE INVENTION

This invention relates to an apparatus for supporting the holding cord and the ends during the knotting process of macrame.

It is an object of this invention to provide a macrame stand which is portable.

It is yet another object of this invention to provide a macrame stand which has means thereon for holding the holding cord taut and for holding the ends.

In the present invention a self-supporting stand has a vertically adjustable, telescoping member which has a cantilevered member thereon for securing the twine to be formed into a macrame knot.

The stand also has a securing means disposed near its lowermost point to secure the lower portion of the holding cord which forms the innermost portion of the macrame knot. Accordingly, the holding cord is held taut while the ends are available for knotting. Since the upper securing means is vertically adjustable, the elevation of work can be appropriately positioned as desired by the user.

Other objects, features, and advantages of the present invention will become apparent with the teaching of the principles of the invention in connection with the disclosure of the preferred embodiments thereof as shown in the drawings and described in the specification and claims.

DETAILED DESCRIPTION OF A PREFERRED EMBODIMENT

Figure 1:
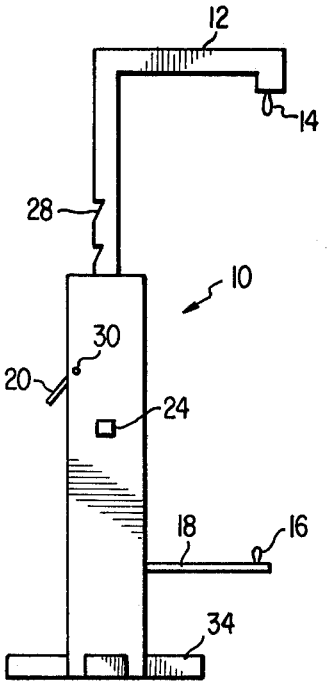
FIG. 1 is a diagramatic side view of a preferred embodiment of the present invention.

Referring to FIG. 1, there is illustrated a preferred macrame support apparatus 10 having a telescoping, vertically adjustable member 12. Disposed on member 12 is a grasping means 14 for engaging the upper portion of the macrame during its creation.

The grasping or securing means 14 can be any conventional means for selectively opening and closing to engage the macrame holding cord. In a preferred embodiment the clasp 14 might take the form of an alligator clip which is spring biased to thus securely seize the macrame holding cord. Clasp 14 may be on a swivel base to enable the macrame work to be turned or selectively positioned during its creation.

The holding cord is secured between member 14 and grasping member 16 which may be of the same type as member 14. One will find that a rugged clasp is desired to thus securely bind the holding cord and withstand heavy usage.

Securing means 14 is mounted on the upper surface of cantilevered member 18. The exact length of member 18 and the horizontal portion of member 12 should be complimentary to thus position the holding cord vertically.

Member 12 is vertically adjustable via lever 20. The adjusting means is shown in more detail in FIG. 2 and will be discussed in more detail hereinbelow. Nevertheless, it can now be appreciated that member 12 can easily be positioned vertically with its exact placement being dependent upon the vertical length of member 12 and the height of the ceiling.

Figure 3:
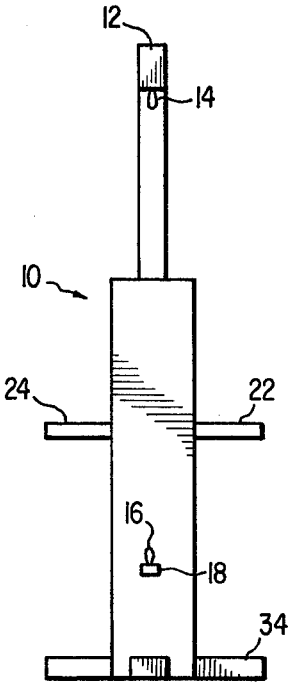
FIG. 3 is a front view of the present invention.

FIG. 3 is a front view of the macrame stand and more fully discloses the horizontally extending arms 22 and 24. These arms are positioned to receive therebetween various ends (pieces of twine) that are not presently being used by the knotter. In many macrame designs the knotter is working with a multiplicity of ends. To prevent some of these from dangling uncontrollably while knotting others, the user may place them behind arms 22 or 24 until they are needed. This keeps the work area open and free of interference.

Figure 2:
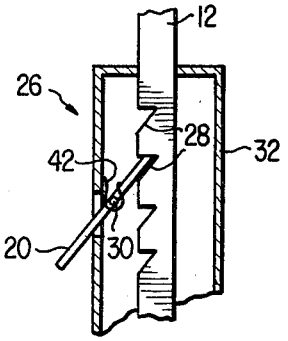
FIG. 2 is a diagramatic view, partly in cross-section showing the adjusting means of the present invention.

Referring now to FIG. 2, the adjusting means 26 may be seen in more detail. Lever 20 is dimensioned to interface with recesses 28 within vertical member 12. The pivot point 30 of lever 20 is within vertical housing 32 such that lever 20 is checked in its downward motion or clockwise rotation by housing 32.

To adjust the height of vertically adjustable member 12 the lever 20 is caused to rotate counter clockwise by exerting a downward force on the outward extending portion of lever 20. The vertical member 12 may then be manually adjusted. It should be remembered that other means may be used to accomplish vertical adjustment of member 12.

Figure 5:
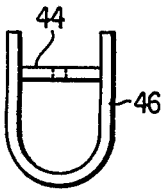
FIG. 5 is a diagramatic view disclosing an alternate support means for the macrame stand.

The stand is maintained in its vertical posture by feet 34 (See FIGS. 1 and 2). Alternate means may be utilized by those skilled in the art to support the stand. An alternate form of a supporting member for the stand 10 is shown in FIG. 5. Vertical housing 32 is secured to support member 44. Member 44 is secured to U-shaped member 46 which actually provides the stability for supporting the remainder of the macrame stand. Such support means provides increased stability while reducing manufacturing difficulty.

Figure 4:
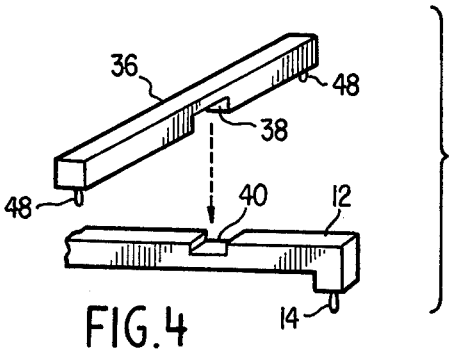
FIG. 4 is an alternative embodiment of the present invention disclosing a horizontal member for supporting larger macrame works.

In some applications it is necessary to hang the sinnet or holding cord from two or more supports. Not all macrame originates from a common point. There may be a plurality of holding cords with respective ends. FIG. 4 shows one variation for accommodating a dowel which could have a plurality of ends thereon. The dowel may be securely supported in a horizontal manner by securing means 48.

Horizontal member 36 may be mated with vertically adjustable member 12 to accommodate a dowel. In the preferred embodiment, mating notches 38 and 40 are provided whereby the two member 36 and 12 can be temporarily secured onto the other.

The macrame stand may be used to support other items when it is not being used for macrame. As an example, the stand may be used to support a hanging basket or other decorative article. In this way the stand is functional even when it is not being used for macrame.

It should be appreciated that many variations of the present structure may be anticipated to respond to various needs of its user. Other arms or extensions may be added at various points to hold ends or to secure multiple holding cords. The adjusting means may be found to be more useful if it takes another form. For example, the lever may be spring-biased by a spring 42 to make the means more secure. Also, a more unsophisticated means such as a peg and complimenting holds could be used to position the vertical member.

It may be desirable to provide an adjustment means which has an inwardly extending member for co-action with recesses 28 wherein said inwardly extending member responds to and is accordingly positioned by a button-like spring-biased member mounted in the wall of vertical member 32. The stand may be fabricated of wood or metal. Though wood may offer enhanced beauty, the dictates of cost may require construction of less expensive material.

Figure 6:
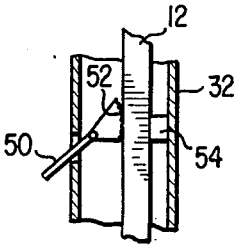
FIG. 6 is a diagramatic view, partly in cross-section disclosing an alternate adjustment means.

An alternate adjustment means is disclosed in FIG. 6. Lever 50 has a knurled surface 52 for contact with vertically adjustable member 12. As member 12 moves in a downward direction, the lever, via knurled portion 52, exerts an ever increasing horizontal force against vertical member 12. Stabilizing means 54 reacts with lever 50 to wedge vertically adjustable member 12 therebetween. It can be seen that lever 12 and more specifically, knurled portion 52, has a surface which moves progressively inwardly as lever 50 rotates in a counterclockwise direction.

From the foregoing it can be seen that applicant has provided a macrame stand that is easily adjustable and portable. While the aforementioned macrame stand has been described in connection with the preferred embodiment, it should be understood that there are other embodiments which fall within the spirit and scope of the present invention as defined by the following claims.

I claim:

1. A stand for use in macrame wherein said stand comprises:

a first vertical member;

a second vertical member disposed partly within said first vertical member and vertically adjustable relative thereto, said second member having a horizontally extending portion adapted to secure macrame thereto; and a horizontally extending member secured to said first vertical member and adapted to secure macrame thereto, said horizontally extending member and the horizontally extending portion of said second member being generally horizontal and extending in the same direction.

2. A stand for use in macrame as set forth in claim 1 to further include an adjusting means to enable said second vertical member to be vertically adjusted relative to said first vertical member, said second member having a plurality of recesses disposed along its length and said adjusting means being a lever rotably mounted in said first vertical member and having a first end positioned for conformal interface with said recesses, said lever co-acting with said first vertical member and said recesses to secure said second vertical member in a desired position.

3. A stand as set forth in claim 2 to further comprise horizontally extending arms positioned on said first vertical member transverse to the direction of said horizontally extending member, said arms being adapted to selectively receive the ends of twine during the practice of macrame.

4. A stand as set forth in claim 3 wherein said arms are adapted to selectively receive the ends of twine by having disposed thereon a plurality of clamp means, said clamp means being rotatably mounted relative to said arms to permit twine secured in said clamps to be rotatably positioned relative to said stand.

5. A stand as set forth in claim 1 to further comprise a transverse member having means thereon for engagement with said horizontally extending portion of said second vertical member, said transverse member having a plurality of securing means for engagement with macrame to securely hold same.

6. A stand as set forth in claim 5 wherein said horizontally extending portion of said second vertical member has means therein cooperating with said means for engagement of said transverse member to securely mate same together, both said means being complimentary rectilinear depressions in said transverse member and said vertical member for mating engagement.

7. A stand as set forth in claim 1 wherein said horizontally extending member co-acts with the horizontally extending portion of said second member to secure therebetween a holding cord.

8. A stand as set forth in claim 1 to further include an adjustment means to enable said second vertical member to be vertically adjusted relative to said first vertical member, said first vertical member having a lever member rotatably mounted therein, said lever having a knurled circular portion thereof positioned to rotatably engage said second member to thus exert pressure sufficient to cause said second member to maintain any desired position within said first member.

9. A stand as set forth in claim 8 to further comprise a stabilizing means positioned within said first vertical member juxtapositional a side of said second vertical member opposite the side of said second vertical member from the side of said second vertical member engaging said knurled portion of said lever.

10. A stand as set forth in claim 1 to further include an adjustment means for vertical adjustment of said second member, said adjustment means comprising a means for exerting an ever-increasing force against said second vertical member as the said second vertical member moves in a downwardly direction.

* * * * *